US005743578A

United States Patent [19]

Schuermann

[11] Patent Number: 5,743,578

[45] Date of Patent: Apr. 28, 1998

[54] COLLAPSIBLE GOLF BALL RETRIEVER

[76] Inventor: William F. Schuermann, 26001 Budde Rd., Apt. 4104, Spring, Tex. 77380

[21] Appl. No.: 774,405

[22] Filed: Dec. 21, 1996

[51] Int. Cl.[6] ..... A63B 57/00

[52] U.S. Cl. ..... 294/19.2; 473/286

[58] Field of Search ..... 473/286, 282; 294/19.2; 56/400.19, 400.2, 400.21

[56] References Cited

U.S. PATENT DOCUMENTS

| | | | |
|---|---|---|---|
| D. 266,264 | 9/1982 | West | D21/206 |
| 2,738,214 | 3/1956 | Zimmers | 294/19.2 |
| 2,935,323 | 6/1960 | Cummings | 294/19.2 |
| 3,046,044 | 7/1962 | Christle | 294/19.2 |
| 3,306,650 | 2/1967 | Zagwyn | 294/24 |
| 3,773,374 | 11/1973 | D'Luhy | 294/19.2 |
| 3,887,225 | 6/1975 | McKee | 294/19.2 |
| 4,254,981 | 3/1981 | Wilson | 294/19.2 |
| 4,493,503 | 1/1985 | Jeninga | 294/19.2 |
| 4,659,125 | 4/1987 | Chuan | 294/19.2 |
| 4,974,894 | 12/1990 | Dubow | 294/19.2 |
| 5,080,413 | 1/1992 | Vobeda | 294/19.2 |

*Primary Examiner*—Sebastiano Passaniti
*Assistant Examiner*—Stephen L. Blau
*Attorney, Agent, or Firm*—Keeling Law Firm

[57] ABSTRACT

A collapsible golf ball retriever that has a plurality of fingers pivotally attached to the connecting end of an elongated handle at a common axis of rotation. Each of the fingers has an attachment end connected to the handle and a distal cage portion. The cage portions are constructed to cooperatively receive and hold a golf ball therein. The fingers may rotate between an aligned position and a fanned position. Because the fingers share a common axis of rotation and are, therefore, stacked, the collapsible golf ball retriever is capable of assuming a very compact form that is able to fit in spaces nearly as small as the golf ball itself.

13 Claims, 5 Drawing Sheets

10
20
24
100
90
22
36
110
50
30
52
80
70
140
84
38
44
82
72
42
40
112
60
122
63
62

COLLAPSIBLE GOLF BALL RETRIEVER

BACKGROUND OF THE INVENTION

1. Field of Invention

This invention relates to an apparatus for retrieving golf balls. More specifically, it is directed to an improved collapsible golf ball retriever that has a telescopic handle and is capable of functioning as either a narrow, single ball retriever or a wide, rake-type retriever.

Golf courses include many different types of hazards designed to make the course more challenging and, therefore, more interesting. Examples of these hazards include, inter alia, lakes, ponds, streams, ravines, deep ditches, wooded thickets, tall grass, rocky areas, and boundary fences or walls. Often during play, golfers inadvertently hit their golf ball into a hazard where it is difficult, or impossible, to retrieve without the aid of a retrieving device.

Because of the wide variety of hazard types, a different type retriever is required for different types of hazards. For example, when the hazard is a fence, the retriever must be relatively narrow to fit through the links, boards, etc. of the fence. Likewise, in a hazard where the retriever is likely to become entangled in the hazard, such as rocks or thickets, a narrow retriever that the golfer may position into narrow spaces is preferable.

However, certain hazards, like ponds, conceal the exact location of the golf ball making retrieval more difficult. Typically, ponds are chemically treated to darken the water and, thereby, reduce the growth of plants and algae. This darkened water limits visibility to only a few inches beneath the surface. In a hazard that limits the visibility of the golfer, a rake-type retriever that covers a broad area and catches golf balls in its tines is preferable.

2. Related Art

Golf ball retrieving devices are known to the prior art. Illustrative of single ball retrieving devices are U.S. Pat. No. 3,046,044, U.S. Pat. No. 3,773,374, U.S. Pat. No. 3,887,225, U.S. Pat. No. Des. 266,264, U.S. Pat. No. 4,493,503, and U.S. Pat. No. 4,659,125. Although these devices are useful for retrieving a single ball, they are ineffective in areas where a rake-type retriever is needed.

Other references disclose rake-type retrievers. Illustrative of these devices are U.S. Pat. No. 3,306,650, U.S. Pat. No. 4,254,981, U.S. Pat. No. 4,974,894, and U.S. Pat. No. 5,080,413. These devices are also beneficial for their intended purposes. Some of these raking devices even provide for adjustment of the distance between the tines. However, none of the devices will compact sufficiently to act as a single ball retriever that can fit into very narrow spaces. To the contrary, the tines of the raking devices are side-by-side and cannot, therefore, adapt to a narrow, single ball retriever design.

Though the above mentioned devices may be helpful for their intended purposes they can be improved to provide greater versatility, efficiency, and usefulness at a lower cost using a simpler design.

SUMMARY OF THE INVENTION

Accordingly, the objectives of this invention are to provide, inter alia, a Collapsible Golf Ball Retriever that:

facilitates retrieval of a golf ball;

compacts to a single golf ball retriever form;

expands into a rake-type golf ball retriever form;

includes a telescopic handle that aids transport and extension of the device's reach;

assists retrieval of golf balls located in all types of hazards including those having narrow spaces and those that obstruct the golfer's view;

allows retrieval of a golf ball in a space nearly as small as the golf ball itself;

uses a single pivot point for a plurality of fingers to provide for the greatest possible compression, or narrowing, of the fingers of the device;

limits the positioning of the individual fingers to provide appropriate spacing when the device is used in the rake-type configuration and to aid alignment of the fingers in the single ball retriever configuration;

has side restrictions that prevent the ball from escaping through the side of the device's cage;

bends upward at its retrieval end to enhance ease of use; and is low in cost and easy to implement.

Other objects of the invention will become apparent from time to time throughout the specification and claims as hereinafter related.

To achieve such improvements, my invention is a collapsible golf ball retriever that has a handle and a plurality of fingers pivotally attached to the connecting end of the handle. Each of the fingers has an attachment end and a distal cage portion. The cage portions are constructed to cooperatively receive and maintain a golf ball therein. The fingers are pivotally connected to the handle at a common axis of rotation.

BRIEF DESCRIPTION OF THE DRAWING

The manner in which these objectives and other desirable characteristics can be obtained is explained in the following description and attached drawings in which.

DETAILED DESCRIPTION OF THE INVENTION

Figures 1, 2:
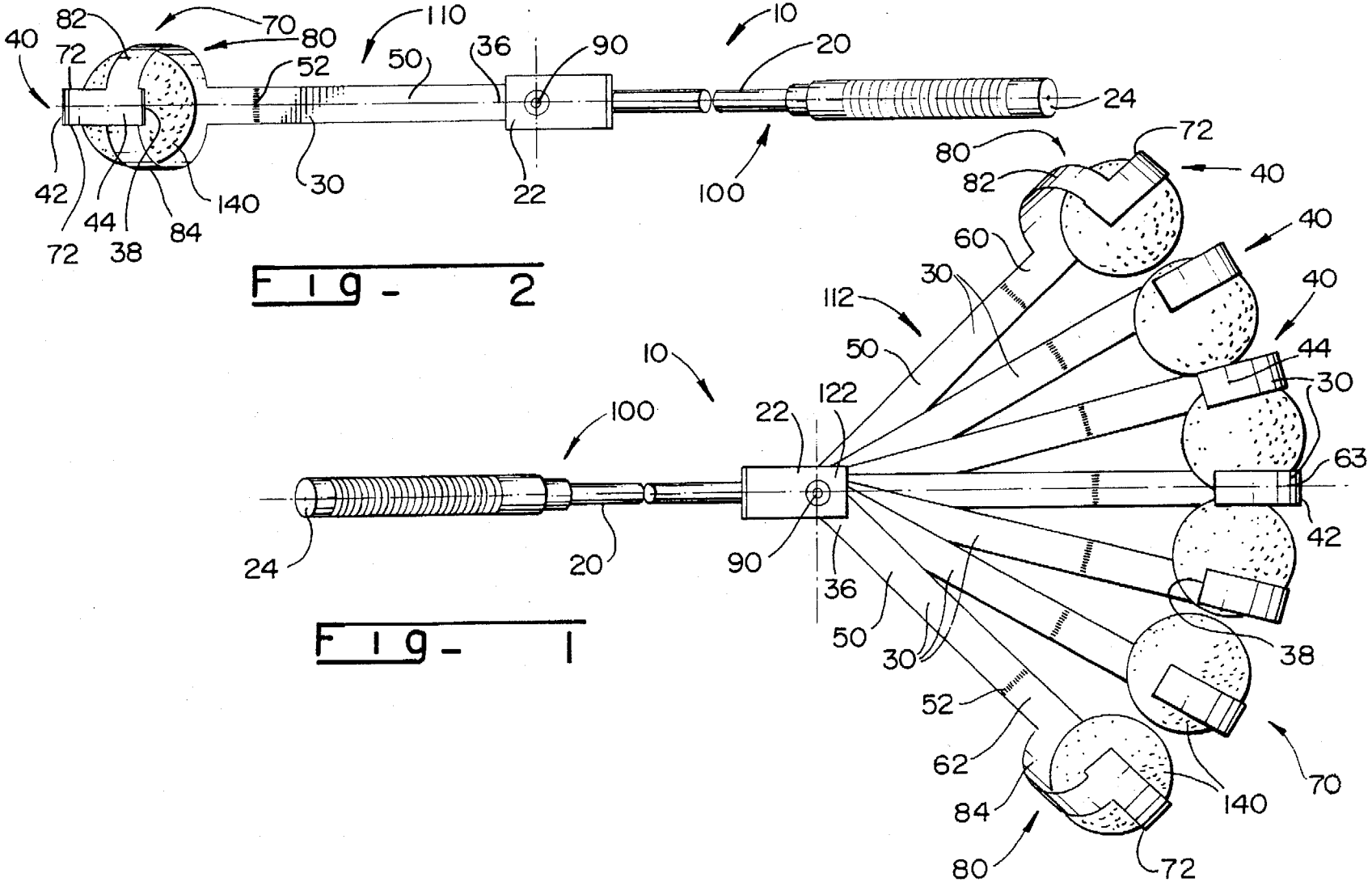
FIG. 1 is a bottom elevational view of the device in the fanned position and holding a plurality of golf balls therein.
FIG. 2 is a bottom elevational view of the device in the aligned position having a golf ball therein.
Figure 3:
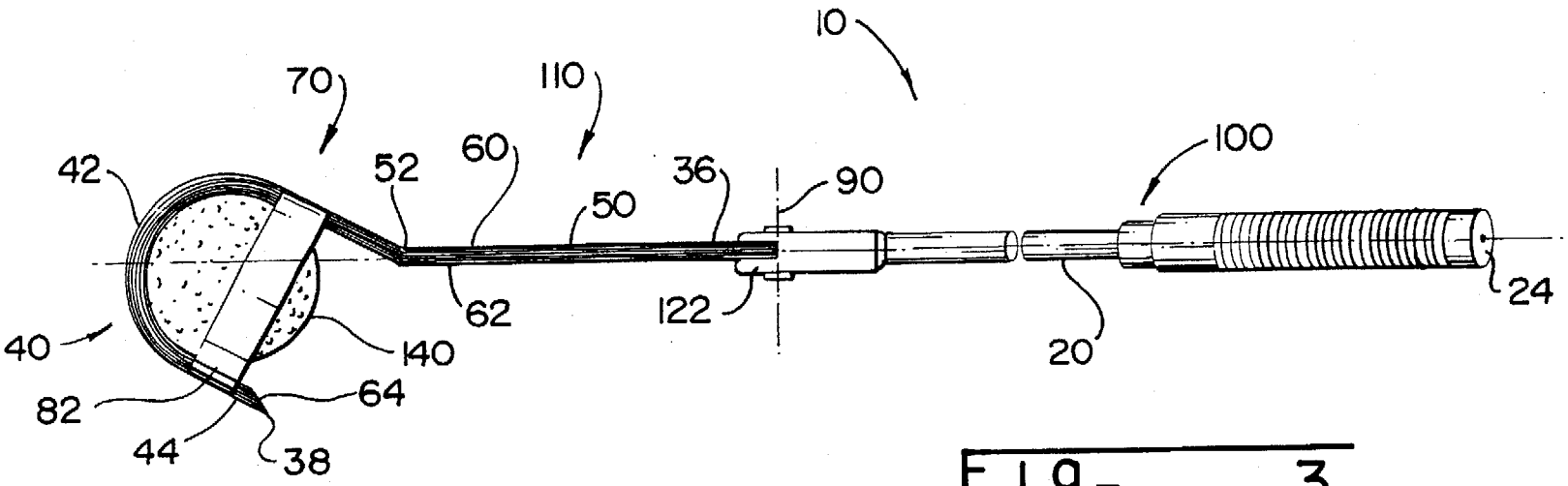
FIG. 3 is a side elevational view of the device in the aligned position having a golf ball therein.
Figure 4:
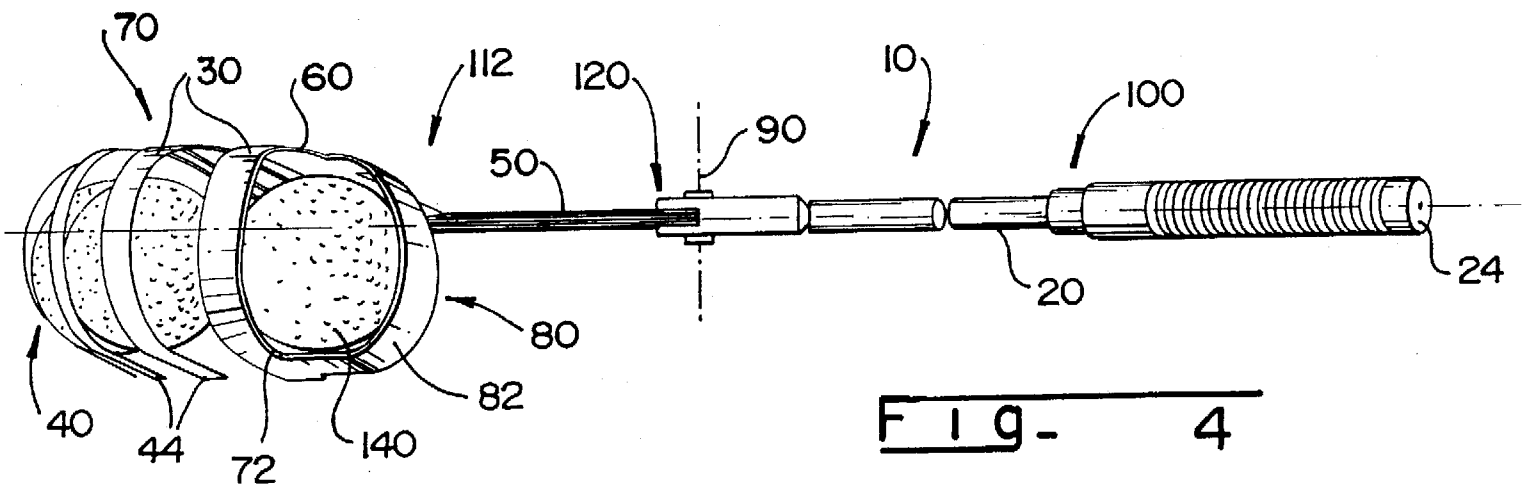
FIG. 4 is a side elevational view of the device in the fanned position and holding a plurality of golf balls therein.
Figure 5:
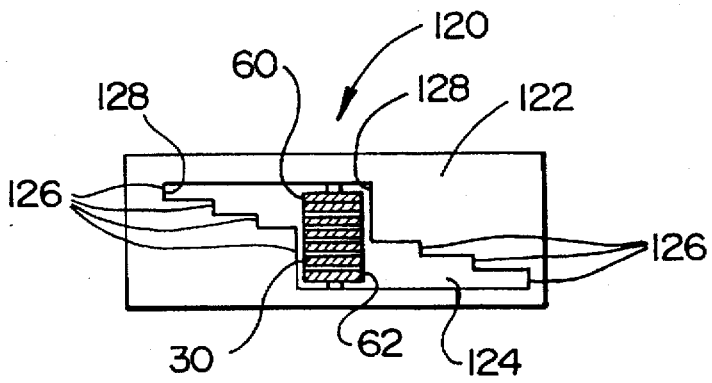
FIG. 5 is a partial cross-sectional end elevational view of the device showing the finger stop means.
Figure 12:
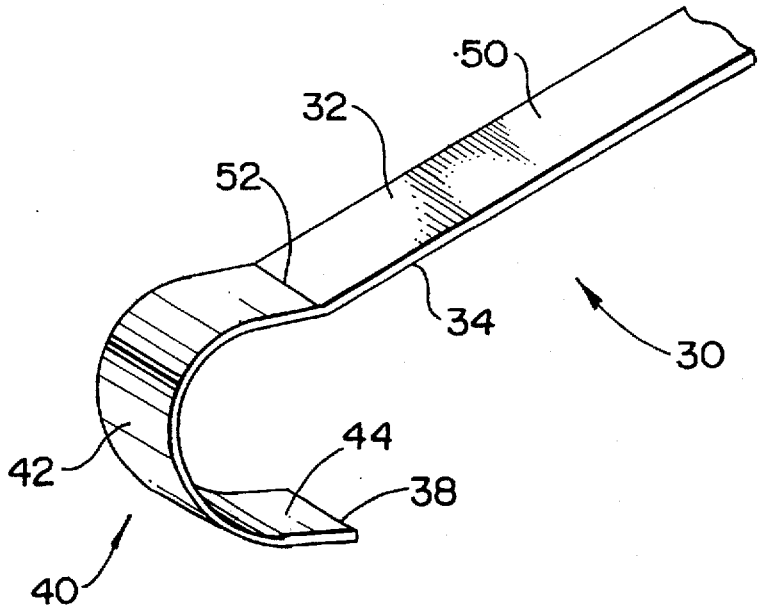
FIG. 12 is a partial isometric view of a single finger.
Figure 7:
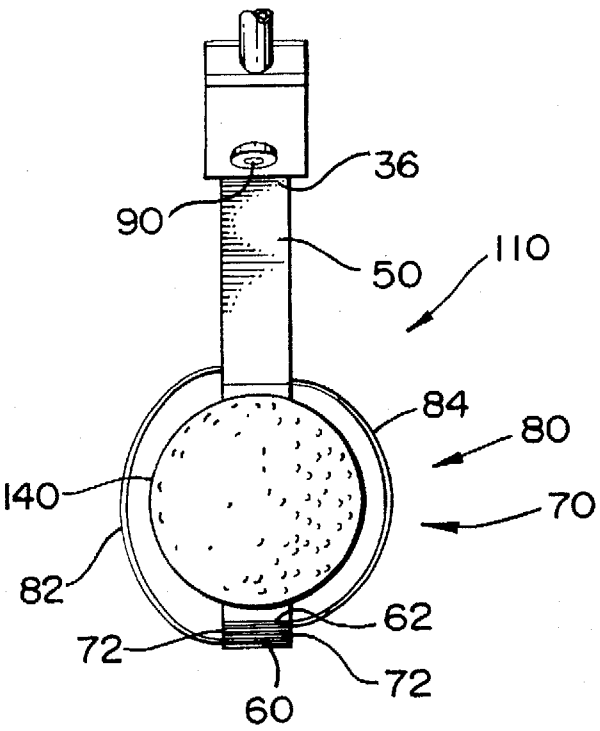
FIG. 7 is a partial bottom elevational view of the device.
Figure 6:
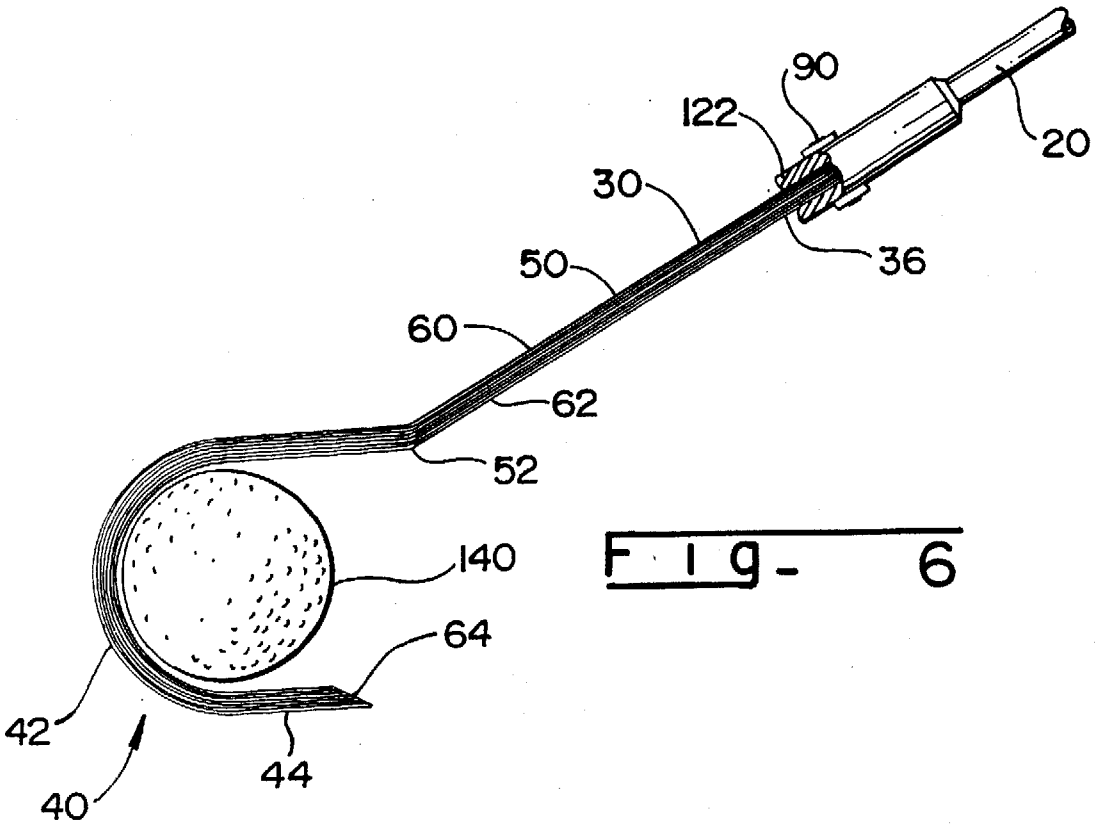
FIG. 6 is a partial cross sectional side elevational view of the device.
Figure 10:
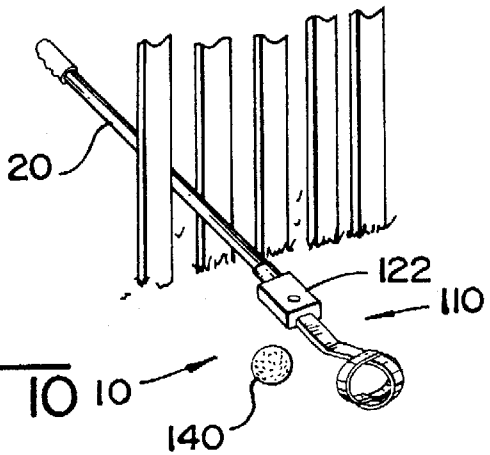
FIG. 10 is an isometric view of the device being used in its aligned position to retrieve a ball through a picket fence hazard.
Figure 11:
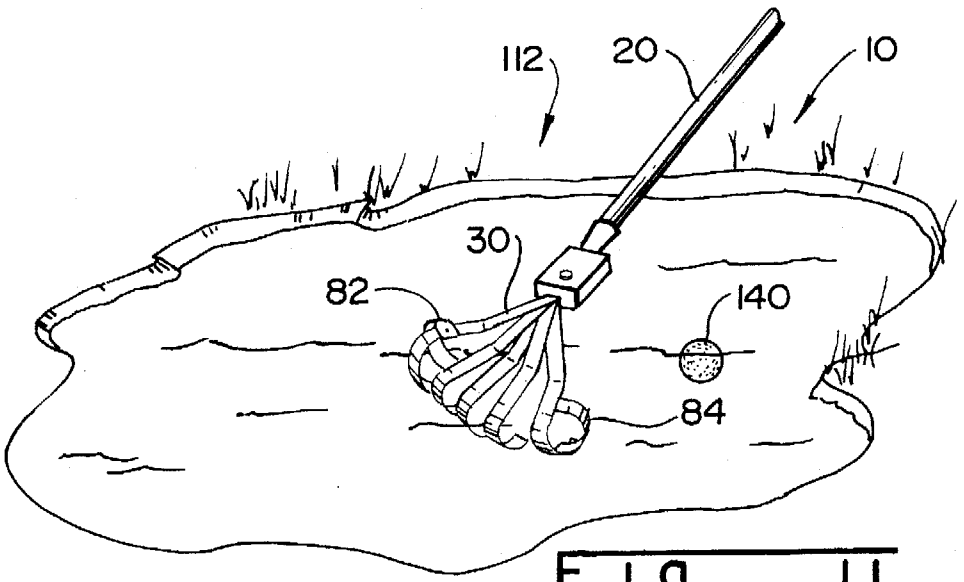
FIG. 11 is an isometric view of the device being used in its fanned position to retrieve a ball from a pond hazard.
Figure 9:
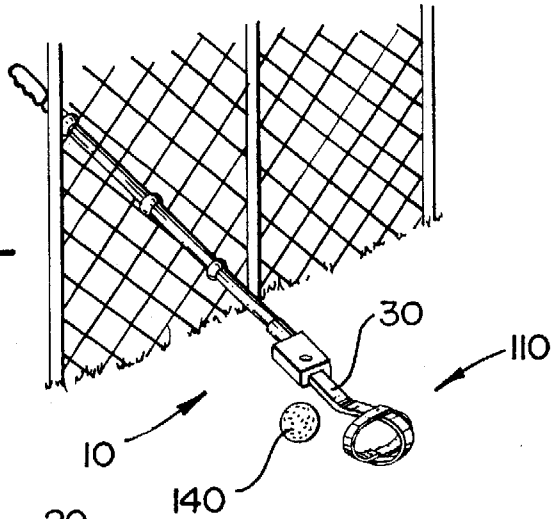
FIG. 9 is an isometric view of the device being used in its aligned position to retrieve a ball through a chain link fence hazard.
Figure 8:
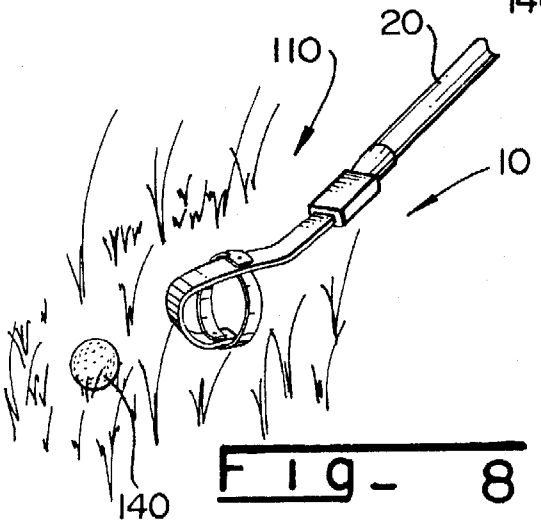
FIG. 8 is an isometric view of the device being used in its aligned position to retrieve a ball from a tall grass hazard.

The preferred embodiment of my invention is illustrated in FIGS. 1 through 12 and the collapsible golf ball retriever is depicted as 10. In general, the collapsible golf ball retriever 10 includes a handle 20 and a plurality of fingers 30 pivotally attached to the handle 20 at a common axis of rotation 90. The fingers 30 include cage portions 40 constructed to cooperatively receive and maintain a golf ball 140 therein.

The handle 20 has a handle connecting end 22 and an opposing handle grip end 24. The construction of the handle grip end 24 allows a golfer to easily grip and hold the collapsible golf ball retriever 10 and, typically, includes a portion constructed to increase the friction between the handle 20 and the user's hand. Preferably, the handle 20 includes telescoping means 100 that facilitates adjustment of the length of the handle 20. As is typical of telescoping devices, the handle 20 is constructed of a plurality of handle sections constructed to slidingly fit together to form the telescoping means 100. Thus, the telescoping means 100 enhances the portability of the collapsible golf ball retriever 10.

A plurality of fingers 30 are pivotally attached to the handle connecting end 22 of the handle 20. Each of the fingers 30 has an upper surface 32, a lower surface 34, an attachment end 36, a free end 38, and a cage portion 40 distal the attachment end 36. The attachment ends 36 of the fingers 30 are pivotally attached to the handle connecting end 22 at a common axis of rotation 90. The pivotal attachment of the fingers 30 to the handle 20 at a common axis of rotation may be accomplished in many ways. Preferably, the attachment is a single pin-type hinge that extends through holes in the attachment ends 36 of the fingers 30.

The fingers 30 are thin relative to their width. Therefore, the upper surface 32 and the lower surface 34 have a substantially greater surface area than the sides of the fingers 30. Each of the fingers 30 have substantially the same widths and thicknesses as the other fingers 30 (i.e. their cross sectional areas are equal). Because the fingers 30 share a common axis of rotation 90, they are preferably stacked in sliding abutment. Having thin fingers 30 stacked in sliding abutment minimizes the total thickness of the collapsible golf ball retriever 10. Minimizing the thickness of the collapsible golf ball retriever 10 (1) allows the collapsible golf ball retriever 10 to fit in smaller spaces, (2) reduces the weight of the collapsible golf ball retriever 10, and (3) reduces the cost of the material for the collapsible golf ball retriever 10.

The top finger 30 of the stack of fingers 30 as determined at the axis of rotation 90 is referred to as the outermost finger 60. Likewise, the bottom finger 30 of the stack of fingers 30 as determined at the axis of rotation 90 is referred to as the innermost finger 62.

In the preferred design, the fingers 30 include an elongated extension portion 50 that extends from the attachment end 36 to the cage portion 40. The extension portion 50 provides an offset between the handle 20 and the cage portions 40. Because the fingers 30 are relatively thin and are, preferably, made from a resilient material, the extension portion 50 allows the cage portions 40 to adjust to the terrain as they are moved across the ground. In this way, a golfer can press the cage portions 40 against the ground and drag the fingers 30 along the ground until the golf ball 140 is entrapped in the cage portions 40. This is particularly useful when the collapsible golf ball retriever 10 is utilized in the fanned position 112 because the individual fingers 30 may adjust to the terrain and maintain contact with the ground. Thus, the collapsible golf ball retriever 10 may more effectively entrap a golf ball 140 therein.

Preferably, the extension portion 50 has a bend 52 therein that forms an obtuse angle in the upper surface 32 of the finger 30. Because the cage portion 40 curves in the direction of the lower surface 34, the bend 52 tends to lift the cage portions 40 toward the user. Therefore, the bend 52 enhances the efficiency of the collapsible golf ball retriever 10 by better aligning the cage portions 40 horizontally to the ground during use. This bend 52 reduces the need for the golfer to stoop or to lower the handle grip end 24 toward the ground in order to effectively operate the collapsible golf ball retriever 10. To properly entrap a golf ball 140 in the cage portions 40, the free ends 38 must remain near the ground during operation of the collapsible golf ball retriever 10. The bend 52 allows the cage portions 40 to use a greater curve and still maintain the free ends 38 near the ground during use. The greater curve is important because it allows the collapsible golf ball retriever 10 to further encompass and better hold a golf ball 140 during retrieval.

The cage portion 40 of the fingers includes a curved portion 42 attached to the extension portion 50 and a straight portion 44 attached to the curved portion 42 opposite the extension portion 50. The curved portion 42 curves in the direction of the lower surface 34 and is, preferably, semicircular. Therefore, the preferred curved portion 42 provides substantially a 180 degree curve. The radius of the curved portion 42 is at least as large as the radius of a golf ball 140. In this way, the curved portion 42 alone can fully envelope one half of a golf ball 140. However, because the fingers 30 are stacked and are in sliding abutment, the curved portion 42 radius of the outermost finger 60 is greater than that of the other fingers 30. The curved portion 42 radii of the fingers 30 decrease from the outermost finger 60 to the innermost finger 62. In other words, the curved portions 42 are constructed to fit within each other. In this way, the fingers 30 maintain sliding abutment along their entire length and may be stacked, one upon the other.

When the fingers 30 are stacked in alignment and abut adjacent fingers 30 along their entire lengths they are said to be in an "aligned position" 110. In this aligned position 110, the angle between the fingers 30 is substantially zero.

Similarly, the straight portions 44 decrease in length with the outermost finger 60 having the greatest length and the innermost finger 62 having the shortest length. Further, the straight portion 44 of the outermost finger 60 extends further from its curved portion 42 than those of the other fingers 30. Adjacent straight portions 44 from the outermost finger 60 to the innermost finger 62 extend less and less far from the curved portions 42. Therefore, when the fingers are in the aligned position 110, the free ends 38 of the fingers 30 form a ramp 64. The resulting ramp 64 angles upward from the outermost finger 60 to the innermost finger 62. Due to the ramp 64, a golfer may more easily scoop a golf ball 140 into the collapsible golf ball retriever 10 when the fingers 30 are in their aligned position 110.

The cage portions 40 of the fingers 30 form a single cage 70 that has cage sides 72. Side enclosure means 80 prevents a golf ball 140 held within the cage 70 from exiting through the cage sides 72. Although the side enclosure means 80 may take a variety of forms, it is preferably a pair of retaining bands, 82 and 84, that each enclose a separate cage side 72. In the preferred embodiment, a first retaining band 82 is attached to the outermost finger 60; and a second retaining band 84 is attached to the innermost finger 62. The retaining bands, 82 and 84, extend in a lateral direction to their attached fingers, 60 and 62. Additionally, the preferred retaining bands, 82 and 84, form semicircles that extend away from the cage sides 72 and have radii equal to the radii of the curved portions 42. More specifically, the first retaining band 82 extends substantially perpendicular from the outermost finger 60 and encloses one cage side 72. Likewise, the second retaining band 84 extends substantially perpendicular from the innermost finger 62 and encloses the opposite cage side 72. When the collapsible golf ball retriever 10 is in the aligned position 110 the retaining bands, 82 and 84, form a complete circle and the fingers 30 form a semicircle perpendicular to the circle. Therefore, a golf ball 140 held within the collapsible golf ball retriever 10 is encircled on three sides. The golf ball 140 enters and exits through the fourth, open side.

To restrict the movement of the fingers 30 and facilitate appropriate alignment and spacing of the fingers 30, the collapsible golf ball retriever 10 preferably includes finger stop means 120. The finger stop means 120 restricts the movement of the fingers 30 between the aligned position 110 and a fanned position 112.

In the fanned position 112, the angle between the fingers 30 is greater than zero. The angle between adjacent fingers 30, in the fanned position 112, is preferably constant with the greatest angle formed between the outermost finger 60 and the innermost finger 62. When in the fanned position 112, the finger stop means 120 limits the distance between adjacent cage portions 40 to less than the diameter of a golf ball 140. Thus, a golf ball 140 cannot pass between adjacent fingers 30. In the fanned position 112, the collapsible golf ball retriever 10 acts as a rake-type retriever.

Preferably, the finger stop means 120 is a sheath 122 that extends from the handle connecting end 22, around a portion of the fingers 30 proximal the attachment end 36, and beyond the axis of rotation. 90. The sheath 122 defines an opening 124 through which the fingers 30 extend. The opening 124 defines a plurality of elongated slots 126 that extend parallel to the plane of rotation of the fingers 30. Each of the slots 126 corresponds to a finger 30. The slots 126 have opposing ends 128 that abut and stop the corresponding finger 30 preventing it from pivoting therebeyond. Due to the compact design of the collapsible golf ball retriever 10, the thickness of the slots 126 is substantially equal to the thickness of the corresponding finger 30.

As shown in the figures, the slots 126 associated with the outermost finger 60 and the innermost finger 62 have the greatest lengths and, thus, allow these fingers to pivot the farthest. The slot 120 associated with the outermost finger 60 allows the outermost finger 60 to pivot between a central aligned position 110 and a fanned position 12 in the direction of the attached first retaining band 82 only. The outermost finger 60 cannot pivot beyond the central aligned position 110 toward the opposite cage side 72. Likewise, the innermost finger 62 can pivot between the central aligned position 110 and a fanned position 112 in the direction of the attached second retaining band 84 only, but not in the direction of the opposite cage side 72. The slots 126 associated with the fingers between the outermost finger 60 and innermost finger 62 limit the rotation of the fingers 30 as described previously (i.e. between the aligned position 110 and a fanned position 112 wherein the angles between adjacent fingers 30 is predetermined). For all of the fingers 30, the associated slots 126 limit the rotation to one of the cage sides 72, but not both. The collapsible golf ball retriever 10 may include a central finger 63 that is limited by its associated slot 126 to prevent pivoting.

In operation, the collapsible golf ball retriever 10 may function as either a single golf ball 140 retriever, in its aligned position 110, or as a rake-type retriever, in its fanned position. For example, when a ball is in a hazard such as tall grass or the out-of-bounds side of a fence (see FIGS. 8 through 10), the collapsible golf ball retriever 10 may be placed in its aligned position 110 to retrieve the ball 140. In its aligned position 110 the collapsible golf ball retriever 10 is capable of fitting within very small spaces including spaces that are almost as small as the ball 140 itself. Also, in this aligned position 110, the collapsible golf ball retriever 10 is less likely to hang on brush, thickets, rocks, or the like.

However, when the golf ball 140 is in a hazard that obscures, or limits, the view of the golfer, the collapsible golf ball retriever 10 may be adjusted to its fanned position 112. In this fanned position 112, the golfer may drag the cage 70 of the collapsible golf ball retriever 10 along the ground in the area where they believe the golf ball 140 to be until the ball is ensnared.

I claim:

1. A collapsible golf ball retriever comprising:

a handle having a handle connecting end and an opposing handle grip end;

a plurality of fingers each having an upper surface, a lower surface, an attachment end, a free end, and a cage portion distal said attachment end;

said cage portions constructed to cooperatively receive and maintain a golf ball therein;

said attachment ends of said plurality of fingers pivotally connected to said handle connecting end at a common axis of rotation;

said plurality of fingers each comprising an elongated extension portion extending from said attachment end to said cage portion;

said elongated extension portion having a bend therein; and said bend forming an obtuse angle in said upper surface.

2. A collapsible golf ball retriever as claimed in claim 1 wherein said handle further comprises telescoping means for facilitating adjustment of the length of said handle.

3. A collapsible golf ball retriever as claimed in claim 1 wherein said plurality of fingers are thin relative to their width.

4. A collapsible golf ball retriever as claimed in claim 1 wherein said cage portion comprises:

a curved portion curving in the direction of said lower surface; and a straight portion opposite said extension portion.

5. A collapsible golf ball retriever as claimed in claim 4 wherein said curved portion provides substantially a 180 degree curve.

6. A collapsible golf ball retriever as claimed in claim 4 wherein said curved portion forms a semicircle.

7. A collapsible golf ball retriever as claimed in claim 1 further comprising:

a cage, defined by said cage portions of said plurality of fingers, having cage sides; and side enclosure means for preventing a golf ball held within said cage from exiting said cage sides.

8. A collapsible golf ball retriever as claimed in claim 7 wherein said side enclosure means comprises:

said plurality of fingers including an outermost finger and a innermost finger;

a first retaining band attached to said outermost finger;

said first retaining band extending in a lateral direction to said outermost finger and providing said side enclosure means for one of said cage sides;

a second retaining band attached to said innermost finger;

said second retaining band extending in a lateral direction to said innermost finger and providing said side enclosure means for the opposite of said cage sides.

9. A collapsible golf ball retriever as claimed in claim 8 wherein:

said first retaining band forming a semicircle extending away from said cage sides; and said second retaining band forming a semicircle extending away from said cage sides.

10. A collapsible golf ball retriever comprising:

a handle having a handle connecting end and an opposing handle grip end;

a plurality of fingers each having an upper surface, a lower surface, an attachment end, a free end, and a cage portion distal said attachment end;

said cage portions constructed to cooperatively receive and maintain a golf ball therein;

said attachment ends of said plurality of fingers pivotally connected to said handle connecting end at a common axis of rotation;

finger stop means for restricting the rotation of said plurality of fingers about said common axis of rotation between an aligned position and a fanned position;

the angle between said plurality of fingers is substantially zero in said aligned position; and the angle between said plurality of fingers is greater than zero in said fanned position.

11. A collapsible golf ball retriever as claimed in claim 10 wherein said finger stop means limits the distance between said adjacent cage portions, when said plurality of fingers are in said fanned position, to less than the diameter of a golf ball.

12. A collapsible golf ball retriever as claimed in claim 10 wherein said finger stop means comprises:

said plurality of fingers are thin relative to their width;

a sheath extending from said handle connecting end, around said plurality of fingers, beyond said axis of rotation;

said sheath defining an opening through which said plurality of fingers extend;

said opening defining a plurality of slots;

each of said plurality of slots corresponds to one of said plurality of fingers;

each of said plurality of slots having opposing ends that abut and stop the corresponding of said plurality of fingers from pivoting therebeyond; and each of said plurality of slots having a thickness that is substantially equal to the thickness of the corresponding of said plurality of fingers.

13. A collapsible golf ball retriever comprising:

a handle having a handle connecting end and an opposing handle grip end;

a plurality of fingers each having an upper surface, a lower surface, an attachment end, a free end, and a cage portion distal said attachment end;

said cage portions constructed to cooperatively receive and maintain a golf ball therein;

said attachment ends of said plurality of fingers pivotally connected to said handle connecting end at a common axis of rotation;

said plurality of fingers pivoting about said common axis of rotation between an aligned position and a fanned position;

the angle between said plurality of fingers is substantially zero in said aligned position;

the angle between said plurality of fingers is greater than zero in said fanned position;

said plurality of fingers including an outermost finger and an innermost finger;

said straight portions of said plurality of fingers decreasing in length from said outermost finger to said innermost finger; and so that said free ends of said plurality of fingers form a ramp.

* * * * *